US009853350B2

(12) United States Patent
Chen et al.

(10) Patent No.: US 9,853,350 B2
(45) Date of Patent: Dec. 26, 2017

(54) ANTENNA MODULE AND WIRELESS COMMUNICATION DEVICE USING SAME

(71) Applicant: Chiun Mai Communication Systems, Inc., New Taipei (TW)

(72) Inventors: Jin-Bo Chen, New Taipei (TW); Cheng-An Chen, New Taipei (TW); Chih-Wei Liao, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 35 days.

(21) Appl. No.: 15/083,434

(22) Filed: Mar. 29, 2016

(65) Prior Publication Data

US 2017/0133745 A1 May 11, 2017

(30) Foreign Application Priority Data

Nov. 11, 2015 (CN) ..... 2015 1 0761916

(51) Int. Cl.

| | |
|---|---|
| ***H01Q 1/24*** | (2006.01) |
| ***H01Q 9/04*** | (2006.01) |
| ***H01Q 21/28*** | (2006.01) |
| ***H01Q 5/371*** | (2015.01) |

(52) U.S. Cl.

CPC ..... *H01Q 1/243* (2013.01); *H01Q 5/371* (2015.01); *H01Q 9/0414* (2013.01); *H01Q 21/28* (2013.01)

(58) Field of Classification Search

CPC ..... H01Q 1/243
USPC ..... 343/702
See application file for complete search history.

(56) References Cited

U.S. PATENT DOCUMENTS

2009/0109104 A1* 4/2009 Ide ..... H01Q 1/243 343/730

* cited by examiner

*Primary Examiner* — Graham Smith
(74) *Attorney, Agent, or Firm* — ScienBiziP, P.C.

(57) ABSTRACT

An antenna module includes a holder, a first feed portion, a second feed portion, a first antenna unit, and a second antenna unit. The holder includes a top surface, an end surface, and a side surface. The first feed portion is positioned on the top surface. The second feed portion is positioned on the top surface and is spaced from the first feed portion. The first antenna unit is positioned on the top surface and the end surface, and is electrically connected to the first feed portion. The second antenna unit is spaced from the second antenna unit and is positioned on the top surface and the side surface. The second antenna unit is electrically connected to the second feed portion. The first feed portion and the second feed portion respectively feed current to the first antenna unit and the second antenna unit.

15 Claims, 4 Drawing Sheets

ANTENNA MODULE AND WIRELESS COMMUNICATION DEVICE USING SAME

CROSS-REFERENCE TO RELATED APPLICATIONS

This application claims priority to Chinese Patent Application No. 201510761916.3 filed on Nov. 11, 2015, the contents of which are incorporated by reference herein.

FIELD

The subject matter herein generally relates to an antenna module and a wireless communication device using same.

BACKGROUND

Antennas are important elements of wireless communication devices, such as mobile phones or personal digital assistants. To communicate in multi-band communication systems, a bandwidth of an antenna in the wireless communication device needs to be wide enough to cover frequency bands of multiple bands. In addition, because of the miniaturization of the wireless communication device, space available for the antenna is reduced and limited.

BRIEF DESCRIPTION OF THE DRAWINGS

Implementations of the present technology will now be described, by way of example only, with reference to the attached figures.

DETAILED DESCRIPTION

Figure 1:
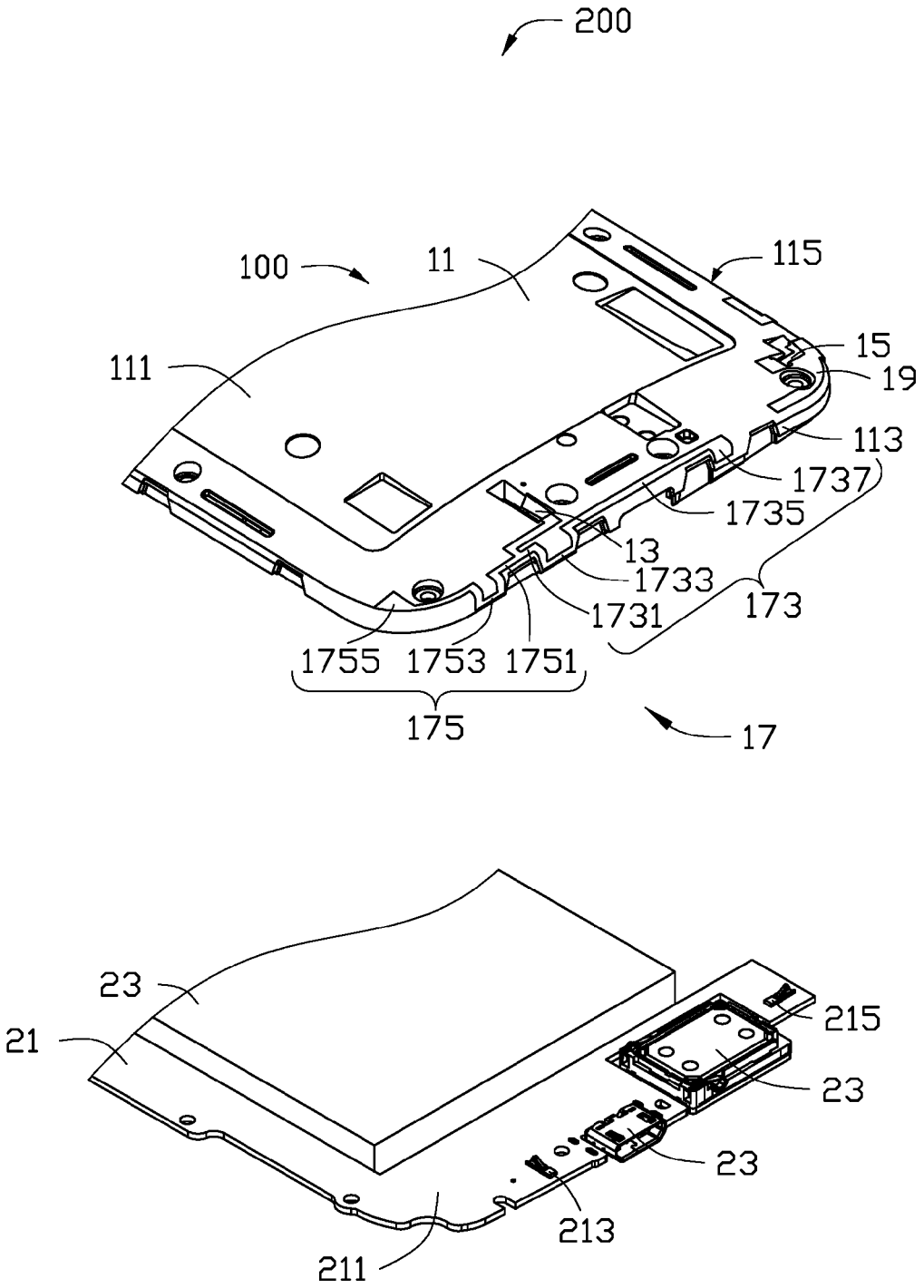
FIG. 1 is an exploded, isometric view of an embodiment of a wireless communication device employing an antenna module.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna module and a wireless communication device using same.

FIG. 1 illustrates an embodiment of a wireless communication device 200 employing an antenna module 100. The wireless communication device 200 can be a mobile phone or a personal digital assistant, for example. The antenna module 100 is configured to receive/send wireless signals.

The wireless communication device 200 further includes a baseboard 21 and at least one electronic element 23. In at least one embodiment, the baseboard 21 can be a printed circuit board (PCB) of the wireless communication device 200. One end of the baseboard 21 defines a keep-out-zone 211. The keep-out-zone 211 has a width of about 7 mm. The purpose of the keep-out-zone 211 is to delineate an area on the PCB in which other electronic elements (such as a camera, a vibrator, a speaker, etc.) cannot be placed. The baseboard 21 further includes a first feed point 213 and a second feed point 215. The first feed point 213 is positioned in the keep-out-zone 211. The second feed point 215 is positioned on one end of the baseboard 21 away from the keep-out-zone 211 and is spaced from the first feed point 213.

In at least one embodiment, the wireless communication device 200 includes three electronic elements 23, for example, a first, second, and third electronic element 231, 232, 233. The first and second electronic elements 231, 232 can be a speaker and a universal serial bus (USB) interface module, respectively. The first and second electronic elements 231, 232 are positioned at one end of the baseboard 21 and are spaced from each other. The first and second electronic elements 231, 232 are positioned between the first feed point 213 and the second feed point 215. The third electronic element 233 can be a battery. The third electronic element 233 is positioned at a middle of the baseboard 21 and is configured to supply power to the wireless communication device 200. The first, second, and third electronic elements 231, 232, 233, and the first feed point 213 are positioned around the keep-out-area 211.

The antenna module 100 includes a holder 11, a first feed portion 13, a second feed portion 15, a first antenna unit 17, and a second antenna unit 19.

The holder 11 corresponds to the baseboard 21 in shape and structure. The holder 11 is covered on the baseboard 21 and is configured to support the first antenna unit 17 and the second antenna unit 19. The holder 11 includes a top surface 111, an end surface 113, and a side surface 115. The end surface 113 is positioned adjacent to the side surface 115. The end surface 113 and the side surface 115 are both perpendicularly connected to the top surface 111.

The first feed portion 13 is positioned on the top surface 111. The first feed portion 13 is electrically connected to the first antenna unit 17 and is further electrically connected to the first feed point 213 of the baseboard 21 through a connecting structure, for example, feeder, probe, shrapnel, or the like, for feeding current to the first antenna unit 17.

The second feed portion 15 is substantially a sheet. The second feed portion 15 is positioned on the top surface 111 and is spaced from the first feed portion 13. The second feed portion 15 is electrically connected to the second antenna unit 19 and is further electrically connected to the second feed point 215 of the baseboard 21 through a connecting structure, for example, feeder, probe, shrapnel, or the like, for feeding current to the second antenna unit 19.

The first antenna unit 17 is positioned on the top surface 111 and the end surface 113. The first antenna unit 17 includes a connecting portion 171 (labeled in FIG. 2), a first radiating portion 173, and a second radiating portion 175. The connecting portion 171 is a meander sheet. One end of the connecting portion 171 is electrically connected to the first feed portion 13. Another end of the connecting portion 171 extends along a direction parallel to the end surface 113 and away from the side surface 115 and further bends and extends along a direction parallel to the side surface 115 and towards the end surface 113.

The first radiating portion 173 and the second radiating portion 175 are both electrically connected to one end of the connecting portion 171 away from the first feed portion 13 and extend along opposite directions. In detail, the first radiating portion 173 is substantially a meander sheet and includes a first meander section 1731, a second meander section 1733, a third meander section 1735, and a fourth meander section 1377 connected in that order. The first meander section 1731 is substantially an L-shaped sheet and is positioned on the top surface 111. One end of the first meander section 1731 is perpendicularly connected to one end of the connecting portion 171 away from the first feed portion 13. Another end of the first meander section 1731 extends along a direction parallel to the end surface 113 and towards the side surface 115 and further extends along a direction parallel to the side surface 115 and towards the end surface 113.

The second meander section 1733 is positioned on the end surface 113. The second meander section 1733 is substantially a U-shaped sheet. One end of the second meander section 1733 is perpendicularly connected to the first meander section 1731 and another end of the second meander section 1733 is perpendicularly connected to the third meander section 1735.

The third meander section 1735 is substantially U-shaped and is positioned on the top surface 111. One end of the third meander section 1735 is perpendicularly connected to one end of the second meander section 1733 away from the first meander section 1731. Another end of the third meander section 1735 extends along a direction parallel to the side surface 115 and away from the end surface 113, then extends along a direction parallel to the end surface 113 and towards the side surface 115, and further extends along a direction parallel to the side surface 115 and towards the end surface 113.

The fourth meander section 1737 is substantially a rectangular sheet. The fourth meander section 1737 is positioned on the end surface 113 and is perpendicularly connected to one end of the third meander section 1735 away from the second meander section 1733.

The second radiating portion 175 is substantially a meander sheet and includes a first radiating section 1751, a second radiating section 1753, and a third radiating section 1755 connected in that order. The first radiating section 1751 is substantially an L-shaped sheet and is positioned on the top surface 111. One end of the first radiating section 1751 is perpendicularly connected to a junction between the connecting portion 171 and the first meander section 1731. Another end of the first radiating section 1751 extends along a direction parallel to the end surface 113 and away from the side surface 115 and further extends along a direction parallel to the side surface 115 and towards the end surface 113.

The second radiating section 1753 is positioned on the end surface 113. The second radiating section 1753 is substantially a U-shaped sheet. One end of the second radiating section 1753 is perpendicularly connected to the first radiating section 1751 and another end of the second radiating section 1753 is perpendicularly connected to the third radiating section 1755.

The third radiating section 1755 is substantially arc-shaped and is positioned on the top surface 111. The third radiating section 1755 is electrically connected to one end of the second radiating section 1753, extends away from the first radiating section 1751 and along a peripheral edge of the top surface 111.

Figure 2:
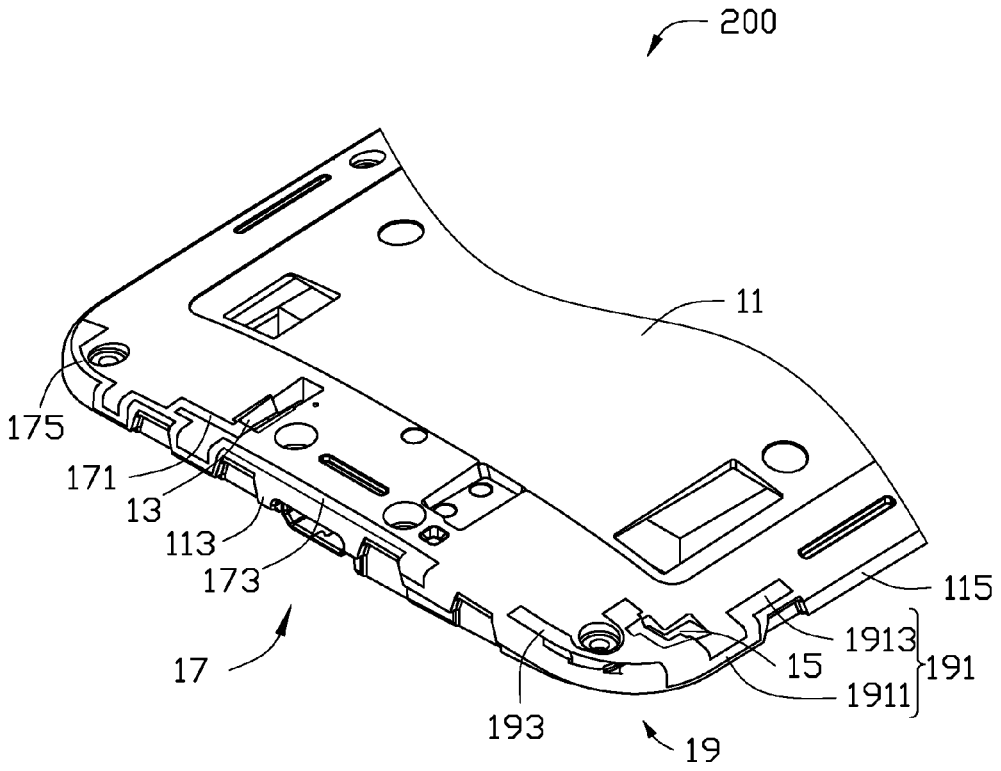
FIG. 2 is an assembled, isometric view of the wireless communication device of FIG. 1.

FIG. 2 illustrates that the second antenna unit 19 is positioned on the top surface 111 and the side surface 115. The second antenna unit 19 is spaced from the first antenna unit 17. The second antenna unit 19 includes a first resonating portion 191 and a second resonating portion 193.

The first resonating portion 191 includes a first resonating section 1911 and a second resonating section 1913. The first resonating section 1911 is positioned on the side surface 115 and is substantially a U-shaped sheet. One end of the resonating section 1911 is perpendicularly connected to the second feed portion 15. Another end of the resonating section 1911 is perpendicularly connected to the second resonating section 1913.

The second resonating section 1913 is substantially a rectangular sheet and is positioned on the top surface 111. One end of the second resonating section 1913 is electrically connected to one end of the first resonating section 1911 away from the second feed portion 15. Another end of the second resonating section 1913 extends along a direction parallel to the side surface 115 and away from the end surface 113.

The second resonating portion 193 is substantially arc-shaped and is positioned on the top surface 111. The second resonating portion 193 is electrically connected to a junction between the second feed portion 15 and the first resonating section 1911 and extends towards the first antenna unit 17.

When the wireless communication device 200 is operated, current enters the first antenna unit 17 through the first feed point 213 and the first feed portion 13 to activate corresponding resonating modes, thus the wireless communication device 200 can work at frequency bands of about GSM850/EGSM900 (824~960 MHz) and DCS1800/PCS1900/UMTS2100 (1710~2170 MHz). In addition, the current enters the second antenna unit 19 through the second feed point 215 and the second feed portion 15 to activate corresponding resonating modes, thus the wireless communication device 200 can further work at frequency bands of about LTE band17 (704-746 MHz) and LTE band7 (2300-2690 MHz). That is, the antenna module 100 of the wireless communication device 200 can work at common wireless communication systems, such as LTE band17 (704-746 MHz), GSM850 (824-894 MHz), EGSM900 (880-960 MHz), LTE band7 (2300-2690 MHz), and DCS1800/PCS1900/UMTS2100 (1710-2170 MHz).

Figure 3:
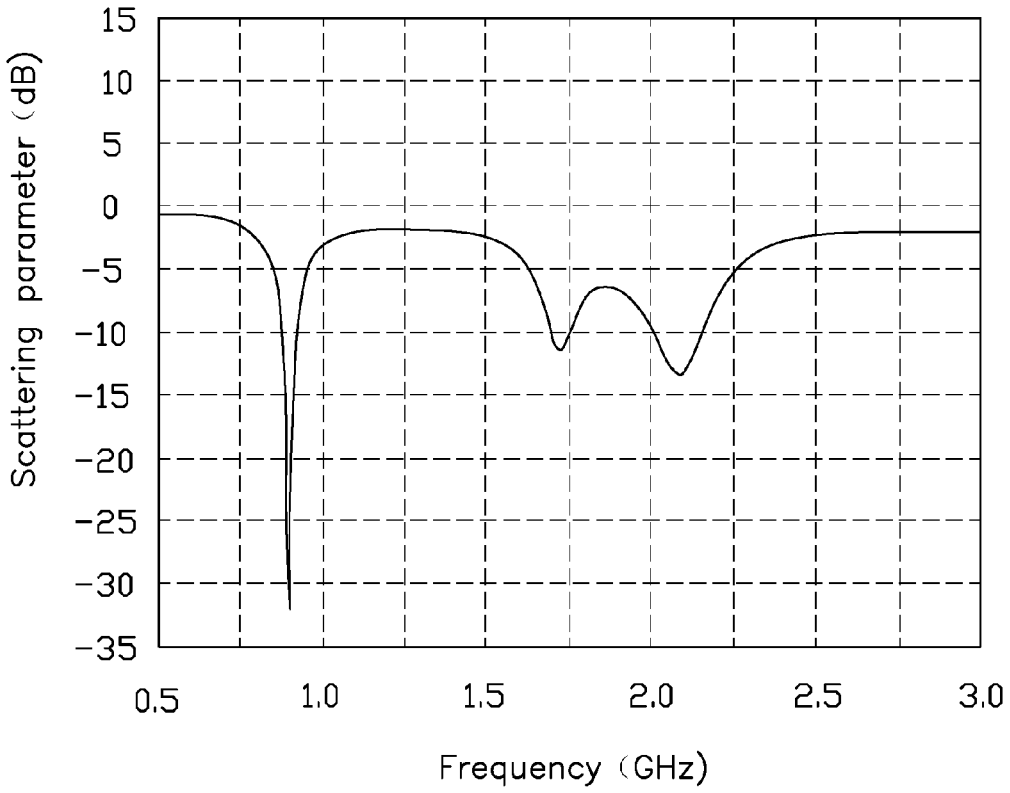
FIG. 3 is a scattering parameter graph of a first antenna unit of the antenna module of FIG. 1.
Figure 4:
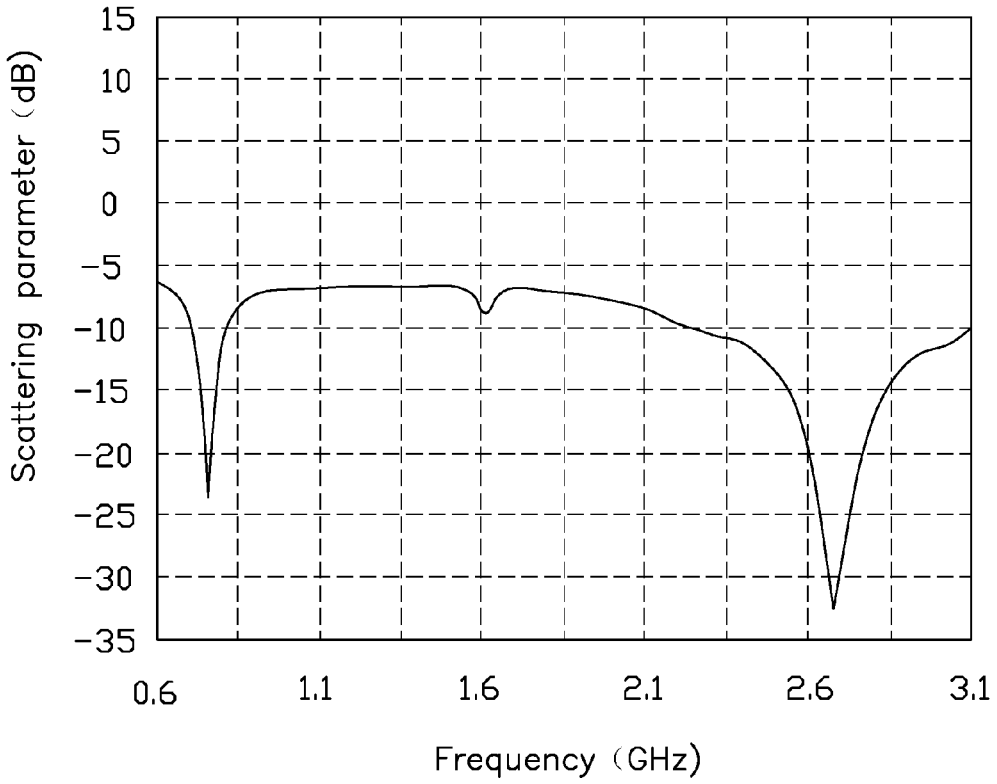
FIG. 4 is a scattering parameter graph of a second antenna unit of the antenna module of FIG. 1.

FIG. 3 illustrates a scattering parameter graph of the first antenna unit 17 of the antenna module 100. FIG. 4 illustrates a scattering parameter graph of the second antenna unit 19 of the antenna module 100. It can be derived from FIGS. 3 and 4 that the wireless communication device 200 can be utilized in common wireless communication systems, such as LTE band17 (704-746 MHz), GSM850 (824-894 MHz), EGSM900 (880-960 MHz), LTE band7 (2300-2690 MHz), and DCS1800/PCS1900/UMTS2100 (1710-2170 MHz), with exceptional communication quality.

Table 1 shows that when the antenna module 100 is utilized in common wireless communication systems, such as LTE band17 (704-746 MHz), GSM850 (824-894 MHz), EGSM900 (880-960 MHz), LTE band7 (2300-2690 MHz), and DCS1800/PCS1900/UMTS2100 (1710-2170 MHz), a gain efficiency ratio of the antenna module 100 satisfies radiation requirements.

TABLE 1 a gain efficiency ratio of the antenna module at different working frequencies

| Working frequencies | Gain efficiency ratio | |
|---|---|---|
| | Transmit (Tx) | Receive (Rx) |
| LTE 700 (US frequency band) | −3.34 | −3.87 |
| LTE 700 (EU frequency band) | −3.65 | −3.58 |
| LTE 2300 | −3.45 | −3.45 |
| LTE 2500 | −4.17 | −4.17 |
| GSM850 | −4.4 | −4.29 |
| EGSM900 | −3.88 | −4.62 |
| DCS1800 | −3.16 | −2.86 |
| PCS1900 | −3.97 | −3.08 |
| UMTS2100 | −3.3 | −4.11 |

The embodiments shown and described above are only examples. Many details are often found in the art such as the other features of the antenna module and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna module comprising:

a holder comprising a top surface, an end surface, and a side surface positioned adjacent to the end surface, the end surface and the side surface both connected to the top surface;

a first feed portion positioned on the top surface;

a second feed portion positioned on the top surface and spaced from the first feed portion;

a first antenna unit positioned on the top surface and the end surface, the first antenna unit electrically connected to the first feed portion; and a second antenna unit being spaced from the first antenna unit and positioned on the top surface and the side surface, and the second antenna unit electrically connected to the second feed portion;

wherein the first feed portion and the second feed portion respectively feed current to the first antenna unit and the second antenna unit;

wherein the first antenna unit comprises a connecting portion, a first radiating portion, and a second radiating portion, the connecting portion is a meander sheet, one end of the connecting portion is electrically connected to the first feed portion, another end of the connecting portion extends along a direction parallel to the end surface and away from the side surface and further extends along a direction parallel to the side surface and towards the end surface, the first radiating portion and the second radiating portion are both electrically connected to one end of the connecting portion away from the first feed portion and extend along opposite directions.

2. The antenna module of claim 1, wherein the first radiating portion is substantially a meander sheet and comprises a first meander section, a second meander section, a third meander section, and a fourth meander section connected in that order, the first meander section is substantially an L-shaped sheet and is positioned on the top surface; the second meander section is positioned on the end surface and is substantially a U-shaped sheet, one end of the second meander section is perpendicularly connected to the first meander section and another end of the second meander section is perpendicularly connected to the third meander section; the third meander section is substantially U-shaped and two ends of the third meander section are perpendicularly connected to the second meander section and the fourth meander section; the fourth meander section is positioned on the end surface and is perpendicularly connected to one end of the third meander section away from the second meander section.

3. The antenna module of claim 2, wherein one end of the third meander section is perpendicularly connected to one end of the second meander section away from the first meander section, another end of the third meander section extends along a direction parallel to the side surface and away from the end surface, another end of the third meander section then extends along a direction parallel to the end surface and towards the side surface, and further extends along a direction parallel to the side surface and towards the end surface.

4. The antenna module of claim 2, wherein the second radiating portion comprises a first radiating section, a second radiating section, and a third radiating section connected in that order, the first radiating section is substantially an L-shaped sheet and is positioned on the top surface, one end of the first radiating section is perpendicularly connected to a junction between the connecting portion and the first meander section, another end of the first radiating section extends along a direction parallel to the end surface and away from the side surface and further extends along a direction parallel to the side surface and towards the end surface; the second radiating section is positioned on the end surface and is substantially a U-shaped sheet, one end of the second radiating section is perpendicularly connected to the first radiating section and another end of the second radiating section is perpendicularly connected to the third radiating section; the third radiating section is substantially arc-shaped and is positioned on the top surface, the third radiating section is electrically connected to one end of the second radiating section away from the first radiating section.

5. The antenna module of claim 1, wherein the second antenna unit comprises a first resonating portion, the first resonating portion comprises a first resonating section and a second resonating section, the first resonating section is positioned on the side surface and is substantially a U-shaped sheet, one end of the resonating section is perpendicularly connected to the second feed portion, another end of the resonating section is perpendicularly connected to the second resonating section; the second resonating section is substantially a rectangular sheet and is positioned on the top surface, one end of the second resonating section is electrically connected to one end of the first resonating section away from the second feed portion, and another end of the second resonating section extends along a direction parallel to the side surface and away from the end surface.

6. The antenna module of claim 5, wherein the second antenna unit further comprises a second resonating portion, the second resonating portion is substantially arc-shaped and is positioned on the top surface, the second resonating portion is electrically connected to a junction between the second feed portion and the first resonating section and extends towards the first antenna unit.

7. A wireless communication device comprising:

a baseboard; and an antenna module comprising:

a holder covered on the baseboard and comprising a top surface, an end surface, and a side surface positioned adjacent to the end surface, the end surface and the side surface both connected to the top surface;

a first feed portion positioned on the top surface;

a second feed portion positioned on the top surface and spaced from the first feed portion;

a first antenna unit positioned on the top surface and the end surface, the first antenna unit electrically connected to the first feed portion; and a second antenna unit being spaced from the first antenna unit and positioned on the top surface and the side surface, and the second antenna unit electrically connected to the second feed portion;

wherein the first feed portion and the second feed portion respectively feed current to the first antenna unit and the second antenna unit;

wherein the first antenna unit comprises a connecting portion, a first radiating portion, and a second radiating portion, the connecting portion is a meander sheet, one end of the connecting portion is electrically connected to the first feed portion, another end of the connecting portion extends along a direction parallel to the end surface and away from the side surface and further extends along a direction parallel to the side surface and towards the end surface, the first radiating portion and the second radiating portion are both electrically connected to one end of the connecting portion away from the first feed portion and extend along opposite directions.

8. The wireless communication device of claim 7, wherein the baseboard comprises a first feed point and a second feed point spaced from the first feed point, the first feed point is electrically connected to the first feed portion, and the second feed point is electrically connected to the second feed portion.

9. The wireless communication device of claim 7, wherein the first radiating portion is substantially a meander sheet and comprises a first meander section, a second meander section, a third meander section, and a fourth meander section connected in that order, the first meander section is substantially an L-shaped sheet and is positioned on the top surface; the second meander section is positioned on the end surface and is substantially a U-shaped sheet, one end of the second meander section is perpendicularly connected to the first meander section and another end of the second meander section is perpendicularly connected to the third meander section; the third meander section is substantially U-shaped and two ends of the third meander section are perpendicularly connected to the second meander section and the fourth meander section; the fourth meander section is positioned on the end surface and is perpendicularly connected to one end of the third meander section away from the second meander section.

10. The wireless communication device of claim 9, wherein one end of the third meander section is perpendicularly connected to one end of the second meander section away from the first meander section, another end of the third meander section extends along a direction parallel to the side surface and away from the end surface, another end of the third meander section then extends along a direction parallel to the end surface and towards the side surface, and further extends along a direction parallel to the side surface and towards the end surface.

11. The wireless communication device of claim 9, wherein the second radiating portion comprises a first radiating section, a second radiating section, and a third radiating section connected in that order, the first radiating section is substantially an L-shaped sheet and is positioned on the top surface, one end of the first radiating section is perpendicularly connected to a junction between the connecting portion and the first meander section, another end of the first radiating section extends along a direction parallel to the end surface and away from the side surface and further extends along a direction parallel to the side surface and towards the end surface; the second radiating section is positioned on the end surface and is substantially a U-shaped sheet, one end of the second radiating section is perpendicularly connected to the first radiating section and another end of the second radiating section is perpendicularly connected to the third radiating section; the third radiating section is substantially arc-shaped and is positioned on the top surface, the third radiating section is electrically connected to one end of the second radiating section away from the first radiating section.

12. The wireless communication device of claim 7, wherein the second antenna unit comprises a first resonating portion, the first resonating portion comprises a first resonating section and a second resonating section, the first resonating section is positioned on the side surface and is substantially a U-shaped sheet, one end of the resonating section is perpendicularly connected to the second feed portion, another end of the resonating section is perpendicularly connected to the second resonating section; the second resonating section is substantially a rectangular sheet and is positioned on the top surface, one end of the second resonating section is electrically connected to one end of the first resonating section away from the second feed portion, and another end of the second resonating section extends along a direction parallel to the side surface and away from the end surface.

13. The wireless communication device of claim 12, wherein the second antenna unit further comprises a second resonating portion, the second resonating portion is substantially arc-shaped and is positioned on the top surface, the second resonating portion is electrically connected to a junction between the second feed portion and the first resonating section and extends towards the first antenna unit.

14. An antenna module comprising:

a holder comprising a top surface, an end surface, and a side surface positioned adjacent to the end surface, the end surface and the side surface both connected to the top surface;

a first feed portion positioned on the top surface;

a second feed portion positioned on the top surface and spaced from the first feed portion;

a first antenna unit positioned on the top surface and the end surface, the first antenna unit electrically connected to the first feed portion; and a second antenna unit being spaced from the first antenna unit and positioned on the top surface and the side surface, and the second antenna unit electrically connected to the second feed portion;

wherein the first feed portion and the second feed portion respectively feed current to the first antenna unit and the second antenna unit;

wherein the second antenna unit comprises a first resonating portion, the first resonating portion comprises a first resonating section and a second resonating section, the first resonating section is positioned on the side surface and is substantially a U-shaped sheet, one end of the resonating section is perpendicularly connected to the second feed portion, another end of the resonating section is perpendicularly connected to the second resonating section; the second resonating section is substantially a rectangular sheet and is positioned on the top surface, one end of the second resonating section is electrically connected to one end of the first resonating section away from the second feed portion, and another end of the second resonating section extends along a direction parallel to the side surface and away from the end surface.

15. The antenna module of claim 14, wherein the second antenna unit further comprises a second resonating portion, the second resonating portion is substantially arc-shaped and is positioned on the top surface, the second resonating portion is electrically connected to a junction between the second feed portion and the first resonating section and extends towards the first antenna unit.

* * * * *